US006743767B2

(12) United States Patent
Goldoni et al.

(10) Patent No.: US 6,743,767 B2
(45) Date of Patent: Jun. 1, 2004

(54) LAUNDRY COMPOSITION

(75) Inventors: Francesca Goldoni, Vlaardingen (NL); Dax Kukulj, Kingston (AU)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 184 days.

(21) Appl. No.: 10/145,010

(22) Filed: May 14, 2002

(65) Prior Publication Data

US 2003/0013631 A1 Jan. 16, 2003

(30) Foreign Application Priority Data

May 17, 2001 (EP) ..... 01304375

(51) Int. Cl.[7] ..... C11D 3/37; D06M 10/00; D06M 15/19

(52) U.S. Cl. ..... 510/475; 510/276; 8/115.51; 8/137

(58) Field of Search ..... 510/276, 475; 8/115.51, 137

(56) References Cited

U.S. PATENT DOCUMENTS 4,555,419 A 11/1985 Huhn et al.

2003/0013631 A1 * 1/2003 Goldoni et al. ..... 510/475

FOREIGN PATENT DOCUMENTS

| | | | | |
|---|---|---|---|---|
| EP | WO 98/14504 | * | 4/1998 | ..... C08G/85/00 |
| WO | 98/14504 | | 4/1998 | |
| WO | 01/25382 | | 4/2001 | |
| WO | 01/27232 | | 4/2001 | |
| WO | 01/27232 | | 4/2002 | |

OTHER PUBLICATIONS

Folmer et al, "Supramolecular Polymer Materials: Chain Extension of Telechelic Polymers Using a Reactive Hydrogen–Bonding Synthon", Advanced Materials 2000, 12, No. 12, pp. 874–878, Apr. 3, 2000.*

PCT Int'l. Search Report No. PCT/EP 02/04863, mailed Sep. 23, 2002, 3 pp.

European Search Report for Appln. No. EP 01 30 4375 dated Oct. 31, 2001.

* cited by examiner

*Primary Examiner*—Brian P. Mruk
(74) *Attorney, Agent, or Firm*—Alan A. Bornstein

(57) ABSTRACT

A fabric treatment composition comprising a textile compatible carrier and a supramolecular polymer, the supramolecular polymer comprising a building block comprising at least two moieties each moiety having at least 3 groups capable of forming cross-linking hydrogen bonds with other building blocks to form the supramolecular polymer.

11 Claims, No Drawings

LAUNDRY COMPOSITION

TECHNICAL FIELD

The present invention relates to an ingredient for laundry cleaning or treatment products, for deposition onto fabric during a washing, rinsing or other treatment process. It further extends to compositions containing such an ingredient and methods of fabrics treatment using these compositions.

BACKGROUND OF THE INVENTION

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process causing fabric to lose its shape.

The present invention is directed towards maintaining the new appearance of fabric, that is to give increased stretch to the fabric and also better return (after being stretched) to the articles original shape (shape retention).

The present invention provides the further benefits of reduced creasing, softness, and also increase comfort during the wearing of an article.

DEFINITION OF THE INVENTION

The present invention relates to a fabric treatment composition comprising a textile compatible carrier and a supramolecular polymer, the supramolecular polymer comprising a building block comprising at least two moieties each moiety having at least 3 groups capable of forming cross-linking hydrogen bonds with other building blocks to form the supramolecular polymer.

A further aspect of this invention is a method of treating fabric comprising the step of applying to the fabric a composition according to the paragraph above.

Also disclosed is the use of a composition comprising a supramolecular polymer comprising a building block comprising at least two moieties each moiety having at least 3 groups capable of forming cross-linking hydrogen bonds with other building blocks to form the supramolecular polymer, to provide elasticity to fabric.

Supramolecular Polymers

The polymers used in this invention can be composed in several ways. The polymers may consist substantially of hydrogen bonding moieties (H-bridge-forming units) with low molecular weight, as a result of which an essentially linear polymer may be formed; also conceivable on the other hand are (essentially) linear polymers in which the hydrogen bonding moieties are linked to two ends of the polymers so that polymeric chains are linked to each other via the hydrogen bonding. In addition, a number of hydrogen bonding moieties can be grafted onto polymers, so that a form of cross-linking via hydrogen bonds may be obtained.

A schematic diagram of the types of hydrogen bonding interactions to form the supramolecular polymers is depicted below:

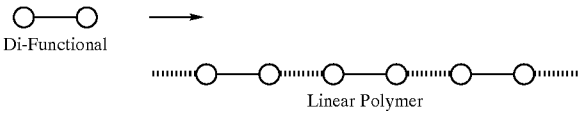

-continued

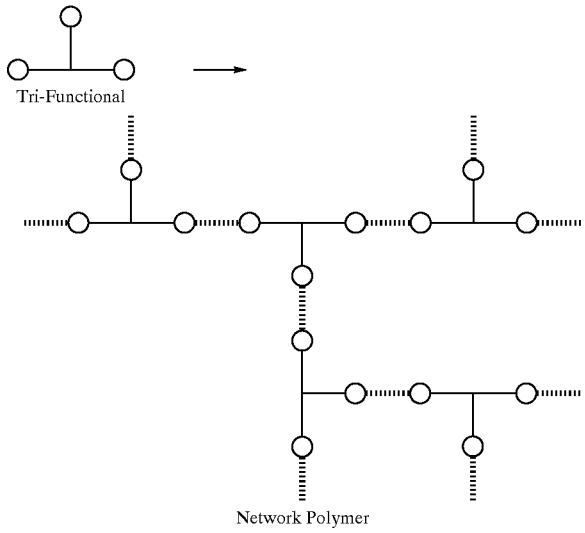

Where represents an H-bridge

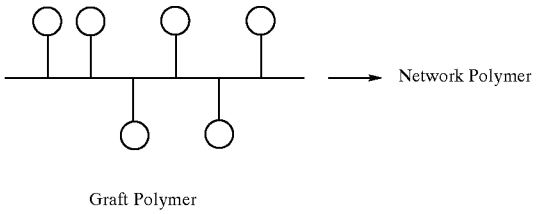

Mixtures of di-functional, tri-functional and grafted species are also possible.

The compositions of the invention comprise supramolecular polymer containing monomeric units that form H-bridges with one another, wherein the hydrogen bond forming moieties are preferably in pairs and at least 3 H-bridges are formed between the pairs, to provide elasticity to fabric.

It is preferable if within the supramolecular polymer that each moieties unit within the building block has at least 4 groups capable of forming cross-linking hydrogen bonds with other building blocks to form the supramolecular polymer.

It is especially preferable if within the supramolecular polymer if there are an even number of groups capable of forming cross-linking hydrogen bonds on the moieties units each moiety has the same structure as the corresponding moiety with which it forms hydrogen bonds. This is especially preferred if there are four or more groups capable of forming hydrogen bonds. It is especially preferred if all the hydrogen bond forming moieties within the supramolecular polymer have the same structure.

The group or groups between the hydrogen bonding moieties with the building block of the polymer may be any covalently attached group or groups. However it is preferred if the group is selected from polyethers, polyesters, polyamides, polyurethanes, polyureas, polyacrylates, polymethacrylates, polyacrylamides, polyvinylacetate, polyvinylalcohol, polyethylene, polybutylene, polybutadiene, vinyl derived polymers or combinations thereof.

It is desirable if the supramolecular polymer is essentially linear. It is also preferable if the hydrogen bonding moiety has an essentially flat structure.

In a preferred embodiment within the supramolecular polymer the hydrogen bond forming moieties contain a structural element having the general form (1) or (2):

(1)

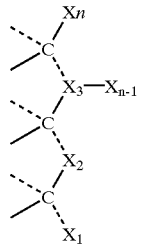

(2)

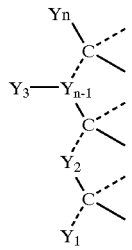

in which the C—$X_i$ and C—$Y_i$ linkages each represent a single or double bond, n is 4 or more and $X_1 \ldots X_n$, represent donors or acceptors that form hydrogen bonds with the hydrogen bond forming moieties containing a corresponding structural element 2 linked to them, with $Y_i$ representing an acceptor if $X_i$ represents a donor, and vice versa.

It is preferable if within the supramolecular polymer the hydrogen bond forming moieties contain a structural element having the general formula (3) or (4):

(3)

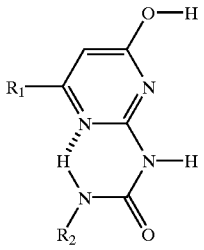

(4)

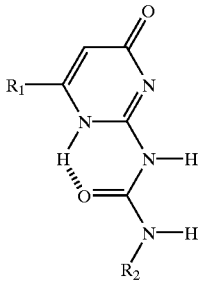

in which $R_1$ represents a co-valent linking unit within the building bridge or a side chain and $R_2$ represents a co-valent linking unit within the building bridge or a side chain; with the proviso that $R_1$ and $R_2$ are not both side chains.

Especially preferred are the polymers having the following structure:

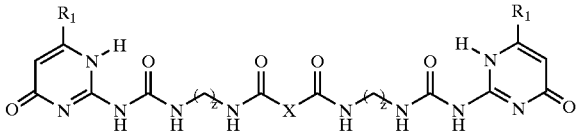

wherein z is 1–16 preferably 6;

and wherein X is selected from:

a) poly(ethylene/butylene)

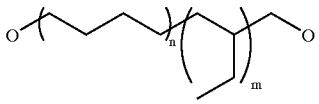

in which n and m are such that the molecular weight is in the range of 500 to 50000 g/mol and preferably approximately 3500 g/mol b) poly(tetramethylene oxide)

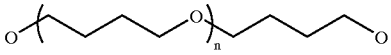

in which n is such that the molecular weight is in the range of 500 to 50000 g/mol and preferably approximately 2000 g/mol c) poly(ethylene oxide)

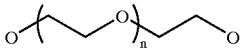

in which n is such that the molecular weight is in the range of 500 to 50000 g/mol and preferably approximately 2000 g/mol d) poly (ethylene oxide-co-propylene oxide)

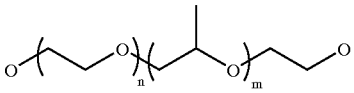

in which n and m are such that the molecular weight is in the range of 500 to 50000 g/mol and preferably approximately 2000 g/mol. The weight percentage of n and m is within the range 1 to 99% and preferably m equals 65%

Polymers containing three hydrogen bonding moieties [structures (3) or (4)] per molecule can be used exclusively or in combination with polymer types (a), (b), (c) and (d) to generate polymer networks. Some examples are:

1) Poly (propylene oxide) with three hydrogen bonding moieties attached in which the molecular weight is within the range of 500 to 50000 g/mol and preferably approximately 700 g/mol.
2) Polymer with the structural formula shown below:

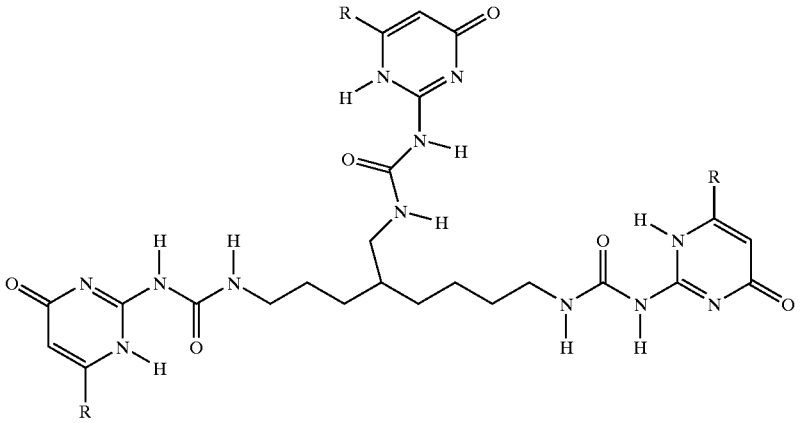

The level of supramolecular polymer within a composition is from 0.5 to 20 wt % of the total composition, more preferably from 1 t % to 12 wt % of the total composition.

It is preferable if the weight of supramolecular polymer per gram of 0.05 to 10%, more preferably 0.1 to 5% and most preferably 0.5 to 2%.

Compositions

The compositions of the invention may be in any physical form e.g. a solid such as a powder or granules, a tablet, a solid bar, a paste, gel or (especially aqueous) liquid. In particular the compositions may be used in laundry compositions, especially in liquid or powder laundry composition, for example for use in a wash and/or rinse and/or drying process.

The compositions of the present invention are preferably laundry compositions, especially rinse-added compositions. The compositions may also be added as main wash (fabric washing) compositions.

Compositions of the invention comprise a textile compatible carrier. In the context of the invention a textile compatible carrier can be selected from surfactants, softening compounds, terpenes, alcohols, water and mixtures thereof.

Limonene is a preferred terpene based textile compatible carrier. Aqueous alcohol solution in particular aqueous solutions of isopropyl alcohol or ethanol are preferred textile compatible carriers.

A perfume may be present with the textile compatible carriers.

Rinse Compositions

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

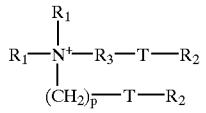

(II)

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $R_3$ is a linear or branched alkylene group of 1 to 5 carbon atoms, T is

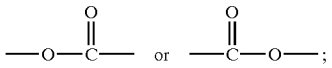

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

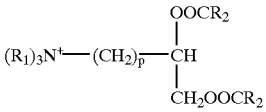

(III)

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain the polyol polyester (eg, sucrose polyester) compounds described in WO 98/16538.

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Main Wash Compositions

The laundry compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may additionally or alternatively contain one or more other anionic surfactants in total amounts corresponding to percentages quoted above for alkyl benzene sulphonates. Suitable anionic surfactants are well-known to those skilled in the art. These include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Some particular examples of such other anionic surfactants are disclosed below alkyl ester sulphonates of the formula R—CH($SO_3$M)—COOR', where R is a $C_8$–$C_{20}$, preferably $C_{10}$–$C_{16}$ alkyl radical, R' is a $C_1$–$C_6$, preferably $C_1$–$C_3$ alkyl radical, and M is an alkaline cation (sodium, potassium, lithium), substituted or non-substituted ammonium (methyl, dimethyl, trimethyl, tetramethyl ammonium, dimethyl piperidinium, etc.) or a derivative of an alkanol amine (monoethanol amine, diethanol amine, triethanol amine, etc.);

alkyl sulphates of the formula $ROSO_3M$, where R is a $C_5$–$C_{24}$, preferably $C_{10}$–$C_{18}$ alkyl or hydroxyalkyl radical, and M is a hydrogen atom or a cation as defined above, and their ethyleneoxy (EO) and/or propyleneoxy (PO) derivatives, having on average 0.5 to 30, preferably 0.5 to 10 EO and/or PO units;

alkyl amide sulphates of the formula $RCONHR'OSO_3M$, where R is a $C_2$–$C_{22}$, preferably $C_6$–$C_{20}$ alkyl radical, R' is a $C_2$–$C_3$ alkyl radical, and M is a hydrogen atom or a cation as defined above, and their ethyleneoxy (EO) and/or propyleneoxy (PO) derivatives, having on average 0.5 to 60 EO and/or PO units;

the salts of $C_8$–$C_{24}$, preferably $C_{14}$–$C_{20}$ saturated or unsaturated fatty acids, $C_8$–$C_{22}$ primary or secondary alkyl sulphonates, alkyl glycerol sulphonates, the sulphonated polycarboxylic acids described in GB-A-1 082 179, paraffin sulphonates, N-acyl,N'-alkyl taurates, alkyl phosphates, isethionates, alkyl succinamates, alkyl sulphosuccinates, monoesters or diesters of sulphosuccinates, N-acyl sarcosinates, alkyl glycoside sulphates, polyethoxycarboxylates, the cation being an alkali metal (sodium, potassium, lithium), a substituted or non-substituted ammonium residue (methyl, dimethyl, trimethyl, tetramethyl ammonium, dimethyl piperidinium, etc.) or a derivative of an alkanol amine (monoethanol amine, diethanol amine, triethanol amine, etc.);

sophorolipids, such as those in acid or lactone form, derived from 17-hydroxyoctadecenic acid;

The compositions of the invention may contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Some particular examples of such nonionic surfactants are:

polyalkoxylenated alkyl phenols (i.e. polyethyleneoxy, polypropyleneoxy, polybutyleneoxy), the alkyl substituent of which has from 6 to 12 C atoms and contains from 5 to 25 alkoxylenated units; examples are TRITON X-45, X-114, X-100 and X-102 marketed by Rohm & Haas Co., IGEPAL NP2 to NP17 made by RHÓNE-POULENC;

$C_8$–$C_{22}$ polyalkoxylenated aliphatic alcohols containing 1 to 25 alkoxylenated (ethyleneoxy, propyleneoxy) units; examples are TERGITOL 15-S-9, TERGITOL 24-L-6 NMW marketed by Union Carbide Corp., NEODOL 45-9, NEODOL 23-65, NEODOL 45-7, NEODOL 45-4 marketed by Shell Chemical Co., KYRO EOB marketed by The Procter & Gamble Co., SYNPERONIC A3 to A9 made by ICI, RHODASURF IT, DB and B made by RHÓNE-POULENC;

the products resulting from the condensation of ethylene oxide or propylene oxide with propylene glycol, ethylene glycol, with a molecular weight in the order of 2000 to 10,000, such as the PLURONIC products marketed by BASF;

the products resulting from the condensation of ethylene oxide or propylene oxide with ethylene diamine, such as the TETRONIC products marketed by BASF;

$C_8$–$C_{18}$ ethoxyl and/or propoxyl fatty acids containing 5 to 25 ethyleneoxy and/or propyleneoxy units;

$C_8$–$C_{20}$ fatty acid amides containing 5 to 30 ethyleneoxy units;

ethoxylated amines containing 5 to 30 ethyleneoxy units;

alkoxylated amidoamines containing 1 to 50, preferably 1 to 25 and in particular 2 to 20 alkyleneoxy (preferably ethyleneoxy) units;

amine oxides such as the oxides of alkyl $C_{10}$–$C_{18}$ dimethylamines, the oxides of alkoxy $C_8$–$C_{22}$ ethyl dihydroxy ethylamines;

alkoxylated terpene hydrocarbons such as ethoxylated and/or propoxylated a- or b-pinenes, containing 1 to 30 ethyleneoxy and/or propyleneoxy units;

alkylpolyglycosides obtainable by condensation (for example by acid catalysis) of glucose with primary fatty alcohols (e.g. U.S. Pat. Nos. 3,598,865; 4,565,647; EP-A-132 043; EP-A-132 046) having a $C_4$–$C_{20}$, preferably $C_8$–$C_{18}$ alkyl group and an average number of glucose units in the order of 0.5 to 3, preferably in the order of 1.1 to 1.8 per mole of alkylpolyglycoside (APG), particularly those having a $C_8$–$C_{14}$ alkyl group and on average 1.4 glucose units per mole a $C_{12}$–$C_{14}$ alkyl group and on average 1.4 glucose units per mole a $C_8$–$C_{14}$ alkyl group and on average 1.5 glucose units per mole a $C_8$–$C_{10}$ alkyl group and on average 1.6 glucose units per mole marketed under the names GLUCOPON 600 EC®, GLUCOPON 600 CSUP®, GLUCOPON 650 EC® and GLUCOPON 225 CSUP® respectively and made by HENKEL;

It is preferred if the level of total non-ionic surfactant is from 0 wt % to 30 wt %, preferably from 1 wt % to 25 wt %, most preferably from 2 wt % to 15 wt %.

Another class of suitable surfactants comprises certain mono-alkyl cationic surfactants useful in main-wash laundry compositions. Cationic surfactants that may be used include quaternary ammonium salts of the general formula $R_1R_2R_3R_4N^+ X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio, optionally together with soap.

Fabric conditioning agents may be present. If the fabric conditioning compound is to be employed in a main wash detergent composition the compound will typically be non-ionic.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$ These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium nonoyloxybenzene sulphonate (SNOBS). The novel quaternary ammonium and phosphonium bleach precursors disclosed in U.S. Pat. Nos. 4,751,015 and 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. Nos. 4,686,063 and 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transistor metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis*, such as the commercially available subtilisins Maxatase (Trade Mark), as supplied by Gist Brocades N.V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive.

It is often advantageous if soil release or soil suspending polymers are present, for example in amounts in the order of 0.01% to 10%, preferably in the order of 0.1% to 5% and in particular in the order of 0.2% to 3% by weight, such as

- cellulose derivatives such as cellulose hydroxyethers, methyl cellulose, ethyl cellulose, hydroxypropyl methyl cellulose, hydroxybutyl methyl cellulose;
- polyvinyl esters grafted onto polyalkylene backbones, such as polyvinyl acetates grafted onto polyoxyethylene backbones (EP-A-219 048);
- polyvinyl alcohols;
- polyester copolymers based on ethylene terephthalate and/or propylene terephthalate units and polyethyleneoxy terephthalate units, with a molar ratio (number of units) of ethylene terephthalate and/or propylene terephthalate/(number of units) polyethyleneoxy terephthalate in the order of 1/10 to 10/1, the polyethyleneoxy terephthalate units having polyethyleneoxy units with a molecular weight in the order of 300 to 10,000, with a molecular weight of the copolyester in the order of 1000 to 100,000;
- polyester copolymers based on ethylene terephthalate and/or propylene terephthalate units and polyethyleneoxy and/or polypropyleneoxy units, with a molar ratio (number of units) of ethylene terephthalate and/or propylene terephthalate/(number of units) polyethyleneoxy and/or polypropyleneoxy in the order of 1/10 to 10/1, the polyethyleneoxy and/or polypropyleneoxy units having a molecular weight in the order of 250 to 10,000, with a molecular weight of the copolyester in the order of 1000 to 100,000 (U.S. Pat. Nos. 3,959,230, 3,962,152, 3,893,929, 4,116,896, 4,702,857, 4,770, 666, EP-A-253 567, EP-A-201 124);
- copolymers of ethylene or propylene terephthalate/polyethyleneoxy terephthalate comprising sulphoisophthaloyl units in their chain (U.S. Pat. Nos. 4,711,730, 4,702,857, 4,713,194);
- terephthalic copolyester oligomers having polyalkyleneoxyalkyl sulphonate/sulphoaroyl terminal groups and optionally containing sulphoisophthaloyl units in their chain (U.S. Pat. Nos. 4,721,580, 5,415,807, 4,877, 896, 5,182,043, 5,599,782, 4,764,289, EP-A-311 342, WO92/04433, WO97/42293);
- sulphonated terephthalic copolyesters with a molecular weight less than 20,000, obtained e.g. from a diester of terephthalic acid, isophthalic acid, a diester of sulphoisophthalic acid and a diol, in particular ethylene glycol (WO95/32997);
- polyurethane polyesters, obtained by reaction of a polyester with a molecular weight of 300 to 4000, obtained from a terephthalic acid diester, possibly a sulphoisophthalic acid diester and a diol, on a prepolymer with isocyanate terminal groups, obtained from a polyethyleneoxy glycol with a molecular weight of 600 to 4000 and a diisocyanate (U.S. Pat. No. 4,201,824);
- sulphonated polyester oligomers obtained by sulphonation of an oligomer derived from ethoxylated allyl alcohol, dimethyl terephthalate and 1,2-propylene diol, having 1 to 4 sulphonate groups (U.S. Pat. No. 4,968, 451);

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 25 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Any suitable method may be used to produce the compounds of the present invention.

Treatment Process

Treatment of the fabric with the polymer can be made by any suitable method such as washing, soaking, steaming, rinsing, spraying of the fabric or contact via an impregnated sheet.

Typically the treatment will involve a washing or rinsing method such as treatment in the main wash or rinse cycle of a washing machine and involves contacting the fabric with an aqueous medium comprising the composition of the present invention.

The present invention will now be explained in more detail by way of the following non-limiting examples.

Synthesis of Materials

The polymers of the Examples were prepared according the method described by Folmer B J B, Sijbesma R P, Versteegen R M, van der Rijt J A J, Meijer E W, ADVANCED MATERIALS, 12, 874, 2000. Polymers A, B and C were prepared by using the appropriate OH terminated polymer.

The polymers had the following formula:

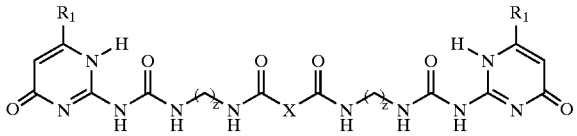

Where z is 6 and X is selected from:

Polymer A

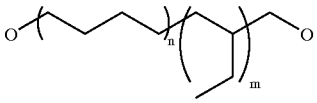

poly (ethylene/butylene)

in which n and m are such that the molecular weight is approximately 3500 g/mol

Polymer B

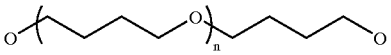

poly (tetramethylene oxide)

in which n is such that the molecular weight is approximately 2000 g/mol

Polymer C

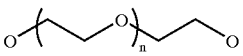

poly (ethylene oxide)

in which n is such that the molecular weight is approximately 2000 g/mol

Polymer D

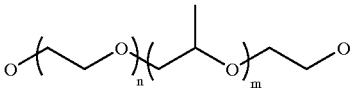

poly (ethylene oxide-co-propylene oxide)

in which n and m are such that the molecular weight is approximately 2000 g/mol. The weight percentage of n and m are such that n equals 35% and m equals 65%.

Polymer containing three hydrogen bonding moieties [structures (3) or (4)] per molecule was used exclusively and in combination with polymer types (a), (b), (c) and (d) to generate polymer networks:

Polymer E

Poly (propylene oxide) with three hydrogen bonding moieties attached in which the molecular weight is within the range of 500 to 50000 g/mol and preferably approximately 700 g/mol.

EXAMPLES

Experimental Procedure

Each polymer was dissolved in a solution of toluene 80% w/w and iso-propanol 20% w/w to give the desired polymer solution concentration. Prewashed woven or knitted cotton fabric was weighed and soaked in the polymer solution for 10 min. The cotton sheets were removed, the excess solvent allowed to drain, weighed and then air dryed at ambient temperature. From the weight of the fabric before and dipping into the solution and the solution concentration it is possible to calculate the percentage of polymer on the fabric. The dried sheets were ironed flat and conditioned at 65% relative humidity and 20° C. for at least 24 hours.

Examples 1–10

Effect on Extension and Return

The effect of the treatments on the maximum and residual extension on woven cotton sheeting was determined using a Testometric Tester (trade mark) tester.

| Testing Conditions: | |
|---|---|
| Sample size: | 150 mm × 50 mm |
| Clamp width: | 25 mm |
| Stretch area: | 100 mm × 25 mm |
| Elongation rate: | 100 mm/min |
| Extension Cycle: | Begin at rest with 0 kg force<br>Extend until 0.2 kg force is attained<br>Return to 0 kg force |

The results are shown in the following table:

TABLE 1

| Example | Treatment | Solution concentration % w/w | Percentage polymer on weight of fabric (% owf) | % Maximum Extension | % Residual Extension |
|---|---|---|---|---|---|
| — | Control solvent | — | — | 7.96 | 3.74 |
| — | Stiffening[a] - PS | 2.0 | 2.02 | 2.39 | 0.35 |

TABLE 1-continued

| Example | Treatment | Solution concentration % w/w | Percentage polymer on weight of fabric (% owf) | % Maximum Extension | % Residual Extension |
|---|---|---|---|---|---|
| — | Softening[b] - CT45E | 2.0 | 2.05 | 14.72 | 4.18 |
| 1 | Polymer A | 0.5 | 0.48 | 12.69 | 3.16 |
| 2 | Polymer A | 1.0 | 0.96 | 12.33 | 2.54 |
| 3 | Polymer A | 2.0 | 1.92 | 11.51 | 2.50 |
| 4 | Polymer A | 5.0 | 5.20 | 8.60 | 2.37 |
| 5 | Polymer B | 0.5 | 0.46 | 11.78 | 3.44 |
| 6 | Polymer B | 1.0 | 1.00 | 10.71 | 2.76 |
| 7 | Polymer B | 2.0 | 2.02 | 9.14 | 2.62 |
| 8 | Polymer C | 0.5 | 0.48 | 9.43 | 3.70 |
| 9 | Polymer C | 1.0 | 0.96 | 10.12 | 3.67 |
| 10 | Polymer C | 2.0 | 1.98 | 9.91 | 3.26 |

[a]Poly(styrene) ex Sigma-Aldrich
[b]Poly(dimethyl siloxane) ex Wacker (applied as emulsion from water)

The stiffening and softening polymers are included as a comparison. All of the polymer treatments A, B and C provide both an increased extension (i.e. easier to stretch) and reduced residual extension (better return after being stretched) compared to the control and stiffening and softening polymers.

Examples 11–20

Softness

The effect of the treatments on softness of woven cotton sheeting was evaluated using a Kawabata Shear Tester. The results are shown in the following table:

TABLE 2

| Example | Treatment | Solution concentration % w/w | Percentage on weight of fabric (% owf) | HG5 |
|---|---|---|---|---|
| — | Control-solvent | — | — | 6.01 |
| 11 | Polymer A | 0.5 | 0.48 | 1.96 |
| 12 | Polymer A | 1.0 | 0.96 | 1.96 |
| 13 | Polymer A | 2.0 | 1.92 | 2.62 |
| 14 | Polymer A | 5.0 | 5.20 | 4.06 |
| 15 | Polymer B | 0.5 | 0.46 | 3.68 |
| 16 | Polymer B | 1.0 | 1.00 | 3.86 |
| 17 | Polymer B | 2.0 | 2.02 | 4.80 |
| 18 | Polymer C | 0.5 | 0.48 | 5.05 |
| 19 | Polymer C | 1.0 | 0.96 | 4.76 |
| 20 | Polymer C | 2.0 | 1.98 | 5.15 |

The lower the H.G. value the softer the fabric as taught in WO92/13053.

A reduction in the value of HG shows that the treatments give an increased level of softness to the fabric.

Examples 21–30

Crease Recovery

The effect of combinations of Polymer D and Polymer E to give network polymers on crease recovery angle was evaluated using a Shirley crease recovery angle tester based on AATCC Test Method 66-1990. 50 mm×25 mm samples were prepared, folded in half and placed under a 1 kg load for 60 seconds. The angle that the sample opened to after 60 seconds was measured. Six measurements were performed in the warp direction on the fabric, from which the average CRA was determined. The results are shown in the following table:

TABLE 3

| Example | Treatment | Percentage polymer on weight of fabric (% OWF) | Crease Recovery Angle (°) |
|---|---|---|---|
| — | Control – solvent | 0 | 73.0 |
| 21 | Polymer C | 0.5 | 72.8 |
| 22 | Polymer C + Polymer E (70/30 wt %) | 0.5 | 77.8 |
| 23 | Polymer D | 0.5 | 84.0 |
| 24 | Polymer D + Polymer E (70/30 wt %) | 0.5 | 84.7 |
| 25 | Polymer E | 0.5 | 87.7 |
| 26 | Polymer C | 2 | 78.5 |
| 27 | Polymer C + Polymer E (70/30 wt %) | 2 | 82.5 |
| 28 | Polymer D | 2 | 88.0 |
| 29 | Polymer D + Polymer E (70/30 wt %) | 2 | 93.0 |
| 30 | Polymer E | 2 | 94.7 |

The polymer treated samples give greater crease recovery angle compared to control. The effect is dose responsive and increases with polymer level. The effect increases as the level of network forming polymer increases.

Examples 31–43

Effect on Knitted Fabric

The effect of the treatments on the percentage immediate recovery was determined using an Testometric Tester (trade mark) using the Ball Bursting strength attachment as detailed in ASTM D3787-89:

| | |
|---|---|
| Sample size: | 400 mm × 80 mm |
| Jaws: | Ball burst device |
| Load cell: | 5 kgf |
| Mode: | Compression |
| Cycle: | Begin at 2 gf<br>Compressed to 50 gf<br>Repeated 5 times; on last cycle held at 50 gf for 120 seconds<br>Released to 2 gf and held for 2 seconds<br>Ball released from fabric for 60 seconds<br>Compressed to 2 gf<br>Returned to start position |

The results are shown in the following table:

TABLE 4

| Example | Treatment | Solution concentration % w/w | Percentage on weight of fabric (% owf) | Percentage Immediate Recovery |
|---|---|---|---|---|
| — | Control-solvent | — | — | 29.0 |
| 31 | Polymer A | 2.0 | 3.7 | 57.4 |
| 32 | Polymer B | 2.0 | 3.8 | 46.6 |
| 33 | Polymer C | 2.0 | 3.6 | 38.4 |

The higher value of percentage immediate recovery shows that the polymer treatments improve the fabric recovery after deformation.

The effect of the level of network formation on the % immediate recovery is shown in the following table:

TABLE 5

| Example | Sample | Percentage polymer on weight of fabric (% owf) | Percentage Immediate Recovery |
|---|---|---|---|
| | Con | 0 | 29.0 |
| 34 | Polymer C | 0.5 | 28.0 |
| 35 | Polymer C + Polymer E (70/30 wt %) | 0.5 | 33.1 |
| 36 | Polymer D | 0.5 | 28.6 |
| 37 | Polymer D + Polymer E (70/30 wt. %) | 0.5 | 40.9 |
| 38 | Polymer E | 0.5 | 49.8 |
| 39 | Polymer C | 2 | 31.2 |
| 40 | Polymer C + Polymer E (70/30 wt %) | 2 | 34.5 |
| 41 | Polymer D | 2 | 36.7 |
| 42 | Polymer D + Polymer E (70/30 wt. %) | 2 | 38.5 |
| 43 | Polymer B | 2 | 50.3 |

The polymer treated samples give greater percentage immediate recovery compared to control. The effect is dose responsive and increases with polymer level. The effect increases as the level of network forming polymer increases.

Example 44

Spray Application Using D-limonene Solvent

Polymer A was dissolved in d-limonene as a solvent to give a 0.5% w/w solution. The solution was applied to the fabric via a spray can (aerosol spray bottle 2430-0200, from Nalge Nunc International). The spray can was held about 10 cm from the cotton sheeting while spraying and the cotton sheeting is left to dry. The resultant level of polymer on the fabric was 0.7%. The dried sheets were conditioned at 65% relative humidity and 20° C. for at least 24 hours. The effect of the treatment on the maximum and residual extension was determined using a Testometric (trade mark) tester as per Examples 1–10.

| | |
|---|---|
| % Maximum Extension: | 13.25 |
| % Residual Extension: | 3.15 |

Example 45

Steam Treatment

Polymer C was dissolved in ethanol/water (50/50 wt %) as a solvent to give a 0.5% w/w solution. The solution was applied to the fabric via a spray can (aerosol spray bottle 2430-0200, from Nalge Nunc International). The spray can was held about 10 cm from the cotton sheeting while spraying and the cotton sheeting is left to dry. The resultant level of polymer on the fabric was 0.6%. Steam was applied with a Ariete Steam tool for about 2 min and the cotton sheeting dried with a hairdryer.

Example 46

Dispersed in Water

Polymer A (0.5 g) was dissolved in methylene chloride (9.5 g). Sodium dodecyl sulfate (0.125 g) was dissolved in water (9.375 g) and 2–3 drops of Silbione silicone anti-foam were added. The two solutions were mixed together to give a 2 phase system. The mixture was ultra-sounded (Branson Sonifier) for 5 minutes using a small screw head probe at output power #10 on the cycle mode (#20). The emulsion obtained was filtered through 125 micron mesh and no coagulum was obtained. The methylene chloride was then removed with reduced pressure on a rotary evaporator at 30° C. The white emulsion obtained was filtered through 125 micron mesh (again no coagulum was formed). The particle size of the emulsion was determined using a Malvern Zetasizer and found to be 330 nm. Final polymer solids are 5% (w/w).

The dispersion was diluted to give 2% w/w solution. Woven cotton sheeting was soaked in the polymer solution for 10 min. The cotton sheets were removed, the excess water allowed to drain and then air dried at ambient temperature. The resultant level of polymer on the fabric was 2.1%.

Examples 47–52

Formulation Examples

Rinse conditioner compositions were prepared in both dilute (47, 49, 51) and concentrated form (48, 50, 52).

TABLE 6

| % Component | Example 47 | Example 48 | Example 49 | Example 50 | Example 51 | Example 52 |
|---|---|---|---|---|---|---|
| Polymer A | 5.00% | 10.0% | — | — | — | — |
| Polymer B | — | — | 5.00% | 10.0% | — | — |
| Polymer C | — | — | — | — | 5.00% | 10.0% |
| Nonionic surfactant | 0.25% | 0.75% | 0.25% | 0.75% | 0.25% | 0.75% |
| HEQ | 4.20% | 13.5% | 4.20% | 13.5% | 4.20% | 13.5% |
| Perfume | 0.30% | 0.95% | 0.30% | 0.95% | 0.30% | 0.95% |
| Water and minors | balance | balance | Balance | Balance | balance | balance |

HEQ is Di(tallowoxyloxyethyl) dimethyl ammonium chloride

What is claimed is:

1. A fabric treatment composition comprising a textile compatible carrier and a supramolecular polymer, the supramolecular polymer comprising a building block comprising at least two moieties each moiety having at least 3 groups capable of forming cross-linking hydrogen bonds with other building blocks to form the supramolecular polymer.

2. A fabric treatment composition according to claim 1 in which the supramolecular polymer comprises a building block comprising at least two moieties each moiety unit having at least 4 groups capable of forming cross-linking hydrogen bonds with other building blocks to form the supramolecular polymer.

3. A fabric treatment composition according to claim 2 in which the moiety unit comprising at least 4 hydrogen bonding groups has the same structure as the corresponding moiety with which it forms hydrogen bonds.

4. A fabric treatment composition according to claim 1 in which the supramolecular polymer is essentially linear.

5. A fabric treatment composition according to claim 1, in which within the supramolecular polymer the hydrogen bond forming moieties contain a structural element having the general form (1) or (2):

(1)

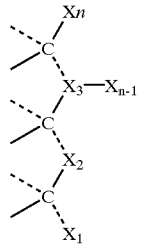

(2)

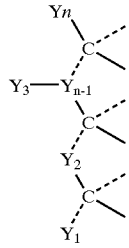

in which the C—$X_i$ and C—$Y_i$ linkages each represent a single or double bond, n is 4 or more and $X_1 \ldots X_n$ represent donors or acceptors that form hydrogen bonds with the hydrogen bond forming moieties containing a corresponding structural element 2 linked to them, with $Y_i$ representing an acceptor if $X_i$ represents a donor, and vice versa.

6. A fabric treatment composition according to claim 1 in which within the supramolecular polymer the hydrogen bond forming moieties contain a structural element having the general formula (3) or (4):

(3)

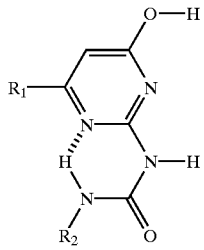

(4)

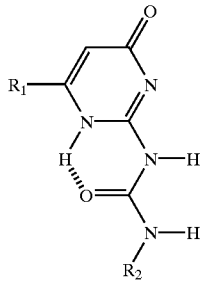

in which $R_1$ represents a co-valent linking unit within the building bridge or a side chain and $R_2$ represents a co-valent linking unit within the building bridge or a side chain; with the proviso that $R_1$ and $R_2$ are not both side chains.

7. A fabric treatment composition according to claim 1 in which within the supramolecular polymer has the formula:

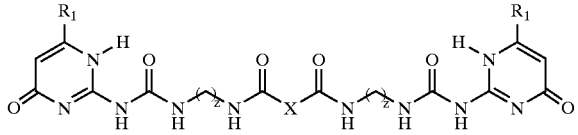

wherein z is 1–16 preferably 6;
and wherein X is selected from:

a) poly(ethylene/butylene)

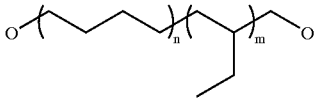

in which n and m are such that the molecular weight is in the range of 500 to 50000 g/mol and preferably approximately 3500 g/mol b) poly(tetramethylene oxide)

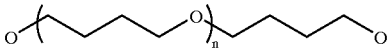

in which n is such that the molecular weight is in the range of 500 to 50000 g/mol and preferably approximately 2000 g/mol c) poly(ethylene oxide)

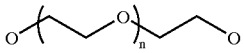

in which n is such that the molecular weight is in the range of 500 to 50000 g/mol and preferably approximately 2000 g/mol d) Poly(ethylene oxide-co-propylene oxide)

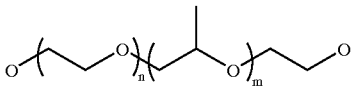

in which n and m are such that the molecular weight is approximately 2000 g/mol, wherein the weight percentage of n and m are such that n equals 35% and m equals 65% e) Poly (propylene oxide) with three hydrogen bonding moieties attached in which the molecular weight is within the range of 500 to 50000 g/mol and preferably approximately 700 g/mol, wherein $R_1$ represents a co-valent linking unit within the building bridge or a side chain.

8. A laundry composition according to claim 1 which further comprises a fabric softening compound.

9. A laundry composition according to claim 1 which further comprises a surfactant.

10. A method of treating fabric comprising the step of applying to the fabric a composition according to claim 1.

11. A method of using a composition according to claim 1 to provide elasticity to fabric.

* * * * *